US006131250A

United States Patent [19]

Fan

[11] Patent Number: 6,131,250

[45] Date of Patent: Oct. 17, 2000

[54] STRUCTURE SPLIT-TYPE LOWER CATCH FOR INVISIBLE ZIPPERS

[76] Inventor: Jeeng-Neng Fan, No. 34, Alley 10, Lane 54, Sec. 2, Yangsin Rd., Yangmei, Taoyuan, Taiwan

[21] Appl. No.: 09/145,247

[22] Filed: Sep. 2, 1998

[51] Int. Cl.[7] ..... A44B 19/38

[52] U.S. Cl. ..... 24/432; 24/433

[58] Field of Search ..... 24/432, 433, 434

[56] References Cited

U.S. PATENT DOCUMENTS 5,586,370 12/1996 Fudaki .

*Primary Examiner*—James R. Brittain

*Attorney, Agent, or Firm*—Rosenberg, Klein & Lee

[57] ABSTRACT

A lower catch for invisible zippers is provided. The lower catch includes a closure block (20) having an attachment slot (201) and an insertion hole (202). An attachment border (103) of a first tooth strip (10) is fixedly secured within slot (201) and a second attachment border (113) of a second tooth strip (11) is fixedly secured to a catch pin (30). When a zipper slider. (50) contacts the closure block (20) and the catch pin (30) is received within the insertion hole (202), the catch pin (30) is held in a fixed position by a guide surface (5041) of slider (50) in order to prevent misalignment of the zipper teeth (40).

2 Claims, 6 Drawing Sheets

STRUCTURE SPLIT-TYPE LOWER CATCH FOR INVISIBLE ZIPPERS

BACKGROUND OF THE INVENTION

The invention herein provides a kind of improved structure split-type lower catch for invisible zippers, specifically referring to a kind that is very simple and convenient in terms of structure, installation and utilization by providing a split-type opening and closure device for invisible zippers that is precise, practical, ideal and progressive and, furthermore, such an improved structure split-type lower catch for invisible zippers has been unavailable until the development of the invention herein.

Conventional invisible zippers are currently non-split type fastener devices (typically utilized on Western apparel, suits, skirts and women trousers) and generally consist of rows of teeth that are fused to two zipper teeth strips utilizing high-frequency heat generating techniques, with the permanent fixing creating a one-piece unit that is physically inseparable. At the same time, the zipper teeth are stitched to the reverse-folded hem on the back surface of the zipper teeth strip. After the zipper teeth strip is sewn to the apparel and the zipper slider is pulled, the zipper teeth are covered by the zipper teeth strip to prevent exposure, and thereby maintain the aesthetic appearance of the apparel. Actually, it is commonly known that the utilization of invisible zippers is increasing because they effectively enhance the attractiveness of clothing and enjoy widespread consumer appreciation and acceptance. However, since the utilization and structure of currently available invisible zippers all have unsplittable openings at the front end, the scope of application is limited to the aforesaid Western apparel and suits, etc., and cannot be utilized for coats, bags, jackets and other items that require a spittable opening at the front end. As such, the effective scope of application is obviously quite restricted and insufficient to accommodate a greater extent of aesthetic appeal. At present, a splittable opening cannot be integrated onto the front end of the aforesaid type of invisible zipper mainly because there are no provisions for positioning the closure block and catch pin of conventional invisible zippers at the front end of the of the aforesaid two zipper teeth strips. If a split-type opening could be placed at the front end of the aforesaid invisible zipper, the scope of application would be expanded and manufacturers have conducted continuous research to achieve such a breakthrough to widen application. However, due to production, operation and other related factors, to date no structure that fulfills all claims has been introduced and no usable product has been released on the market.

SUMMARY OF THE INVENTION

The primary objective of the invention herein is to provide a kind of improved structure split-type lower catch for invisible zippers, of which the adhesive sections of the two zipper teeth strips of the invisible zipper have mutually facing pressure-folded J-shaped attachment borders, and a closure block and catch pin respectively positioned at the lower extent of the aforesaid two attachment borders. The J-shaped attachment borders of the aforesaid two zipper teeth strips are brought together by inserting the catch pin into the closure block. The closure block and catch pin of the invention herein are positioned on the back surface of the respective zipper teeth strips and after being stitched to the apparel, the zipper slider is aligned with guide slot. Since there is an excess section provided at the upper end of the attachment borders, the catch pin is easily moved into the guide slot opening on the front surface of the zipper slider. Furthermore, the catch pin is easily positioned into or extricated from the insertion hole of the closure block, and the two zipper teeth strips can be reliably drawn together or separated to support the precision zippering or unzippering operation of an invisible zipper.

Another objective of the invention herein is to provide a kind of improved structure split-type lower catch for invisible zippers, of which the attachment borders of the aforesaid two zipper strips are conjoined to the front surface of the closure block and catch pin, and the closure block and catch pin are positioned on the back surface the zipper teeth strip, such that after the two zipper teeth strips are drawn together, the closure block and the catch pin are completely covered and no longer visible.

DETAILED DESCRIPTION OF THE INVENTION

Figure 1:
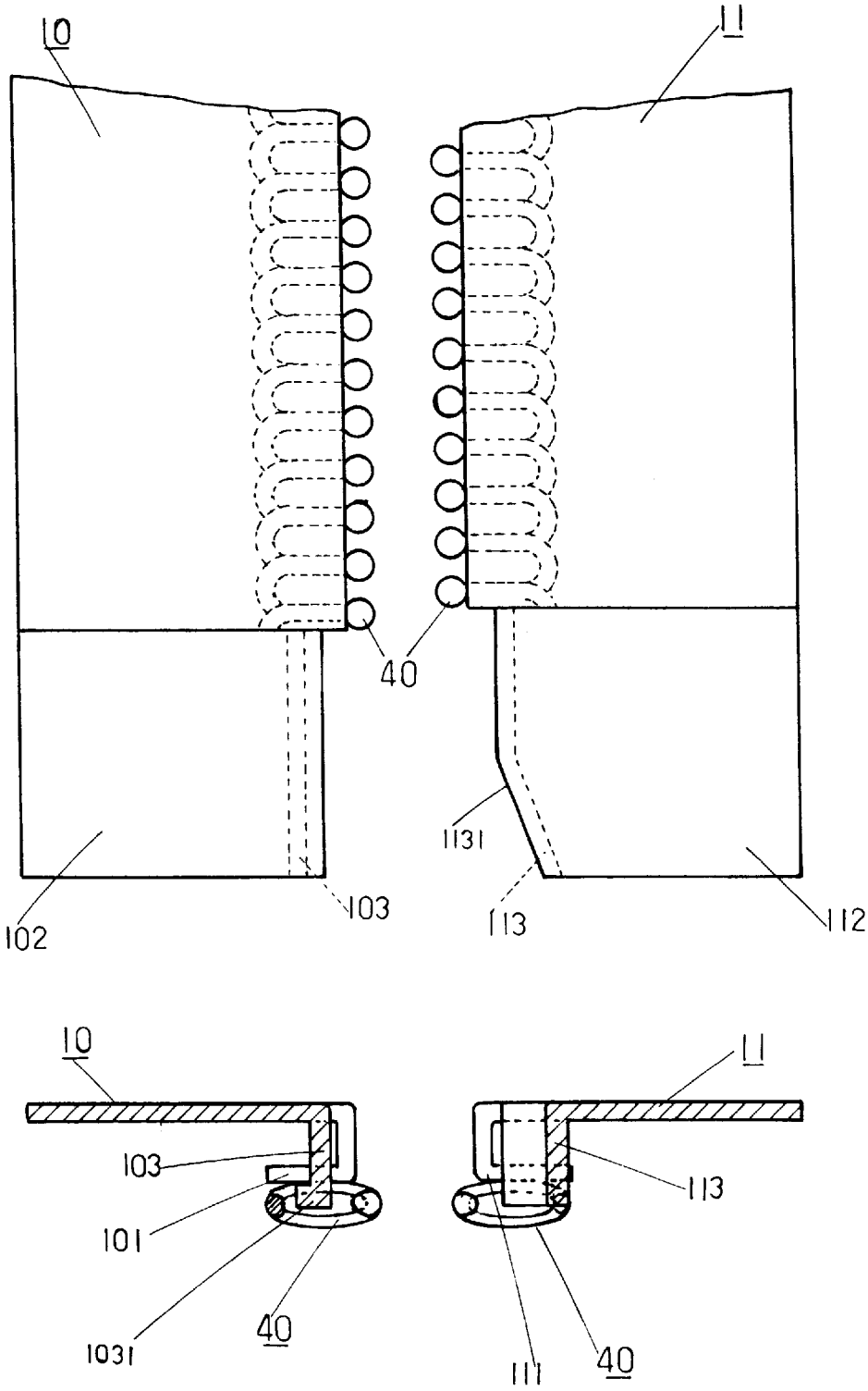
FIG. 1 is a orthographic drawing of the two zipper teeth strips of the invention herein.
Figure 2:
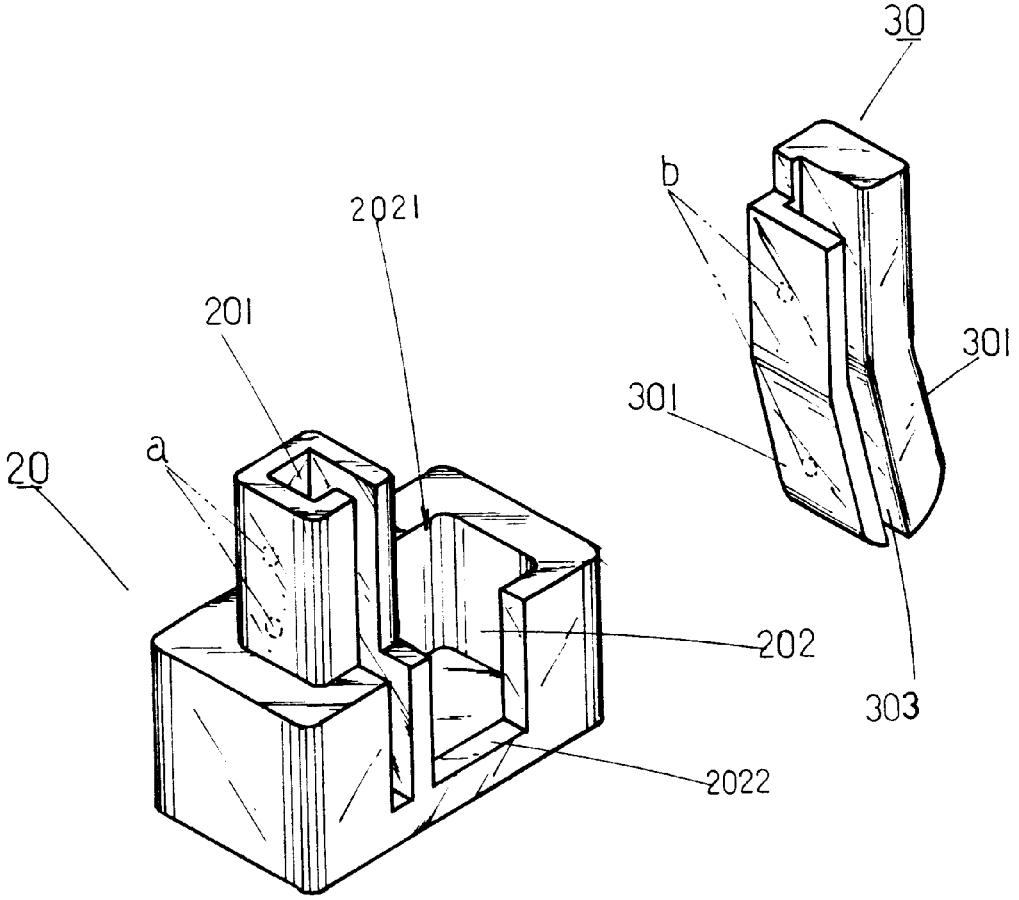
FIG. 2 is an isometric drawing of the closure block and catch pin of the invention herein.
Figure 3:
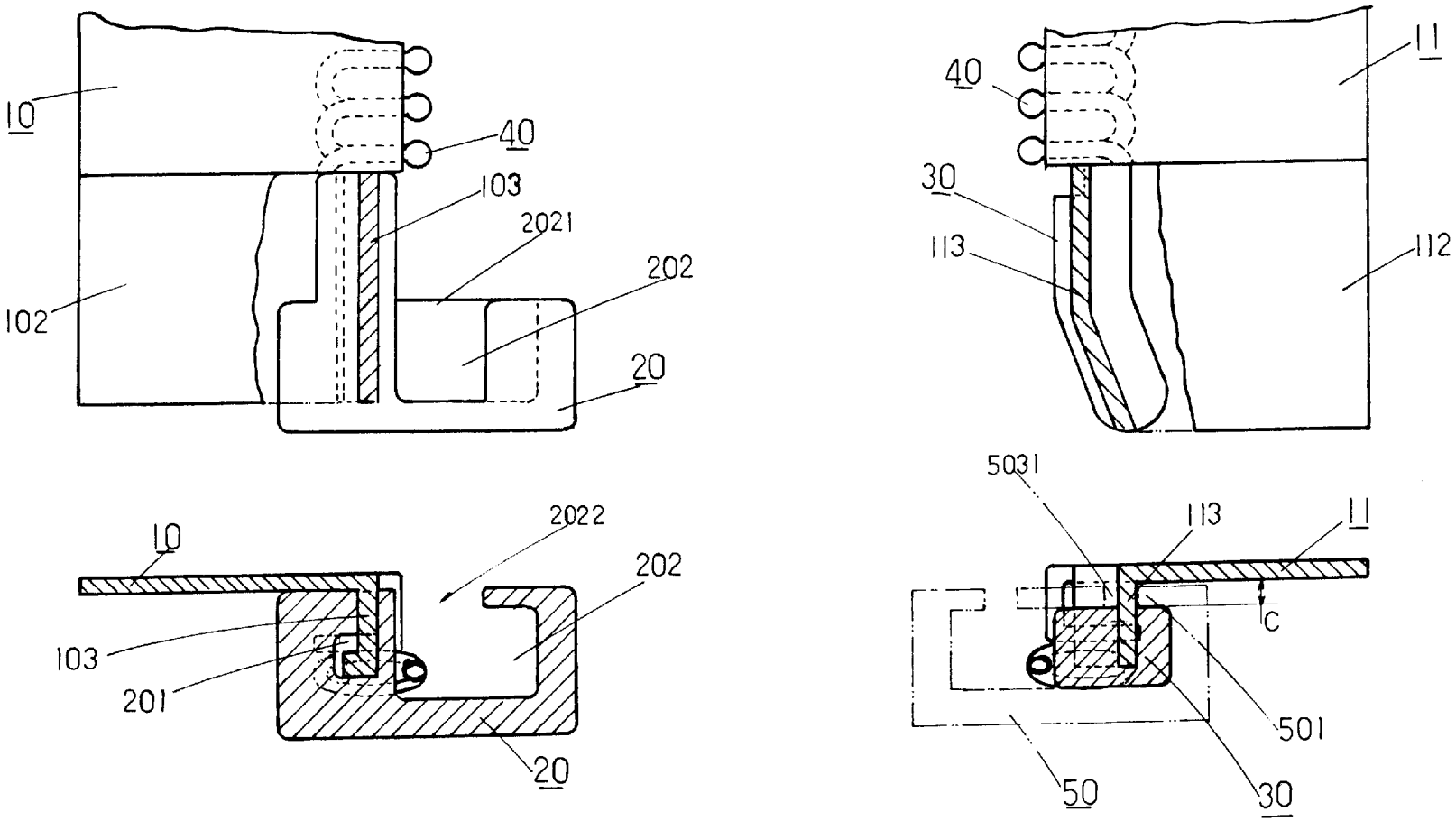
FIG. 3 is a cross-sectional drawing of the closure block and the catch pin as respectively installed on the zipper teeth strips.

Referring to FIG. 1, FIG. 2 and FIG. 3, the invention herein is a kind of improved structure split-type lower catch for invisible zippers that is mainly comprised of a closure block (20) and a catch pin (30) on the front ends of the two zipper teeth strips (10) and (11), respectively.

The aforesaid two zipper teeth strips (10) and (11) consist of a row of teeth (40) that are stitched to the inner side of the reverse-folded hems (101) and (111), respectively, which is similar to conventional units, except that there are J-shaped attachment borders (103) and (113) formed on the mutually facing sides of the adhesive sections (102) and (112) which extend inward from the front end in the direction of the back end; of which, there is an L-shaped horizontal engagement edge (1031) formed at the bottom end of the aforesaid attachment border (103) and, furthermore, there is an angled engagement edge (1131) on the other attachment border (113), which is of an obtuse angular form, with the comer of the angle approximately situated forward of the center section.

The aforesaid closure block (20), which is shaped identically to a conventional unit, is designed with an L-shaped attachment slot (201) along the front surface proximal to the outer side into which is inserted the attachment border (103) of the zipper teeth strip (10) and, furthermore, anchored by the recess points (a); an insertion hole (202) is designed proximal to the inner side at the back surface of the zipper teeth strip (10) and in addition to an entry opening (2021) on the top surface, the aforesaid insertion hole (202) also has a guide opening (2022) facing the front surface that is, furthermore, contiguous with the insertion hole (2021).

The aforesaid catch pin (30) forms an angle between an upper portion and a lower portion and has a guide edge (301)

that angles outward just beyond the center section, with an attachment slot (303) along the edge of the front surface into which the attachment border (113) of the zipper teeth strip (11) is inserted and, furthermore, secured by the recess points (b) when positioned on the back surface of the zipper teeth strip (11); of which, after the attachment border (113) of the zipper teeth strip (11) is inserted into the attachment slot (303), there is a excess section (c) at the upper end that remains uninserted which allows the attachment edge (501) at the front surface of the zipper slider (50) to pass through.

Figure 4:
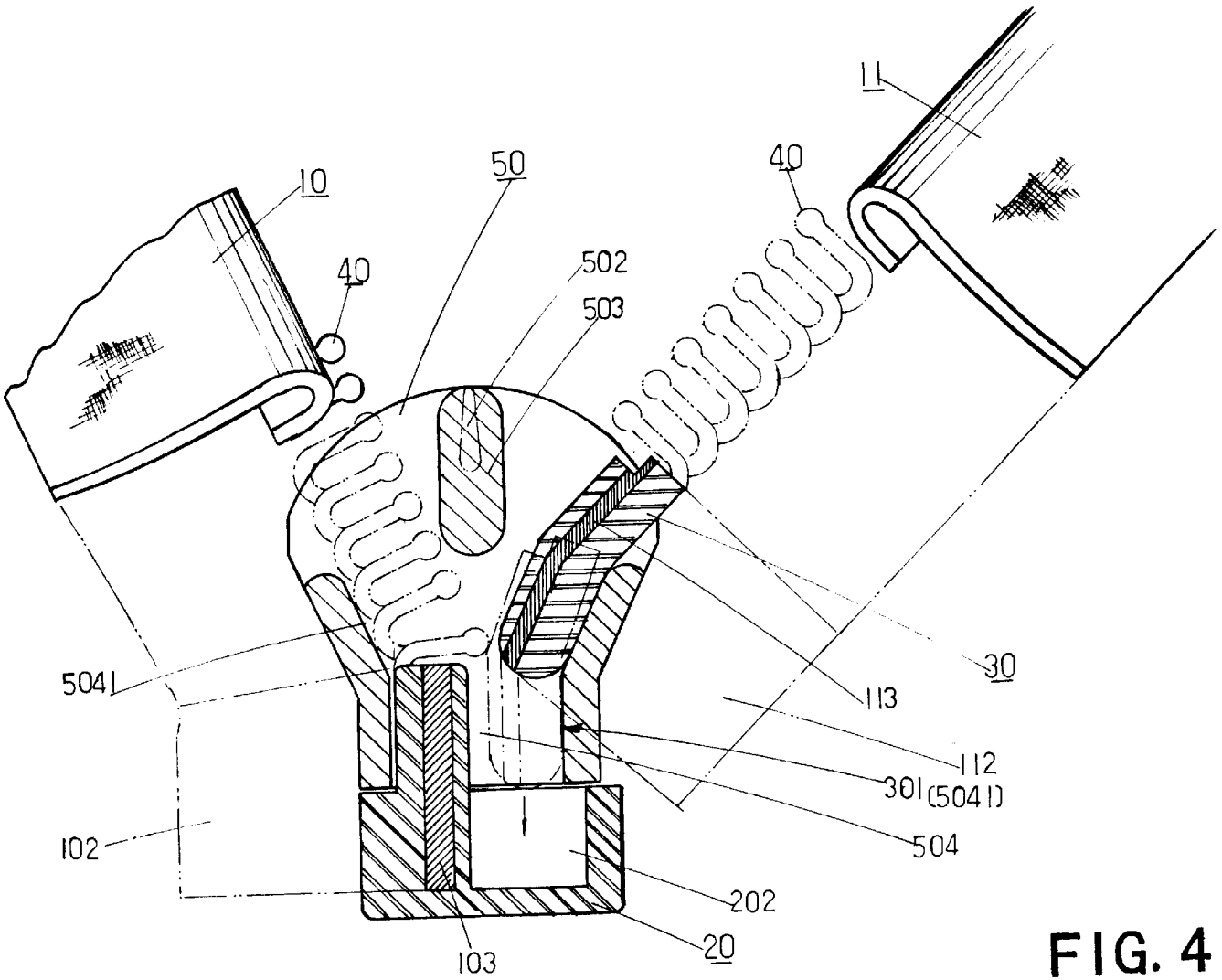
FIG. 4 is an orthographic drawing of the invention herein about to be drawn together with the zipper slider.
Figure 5:
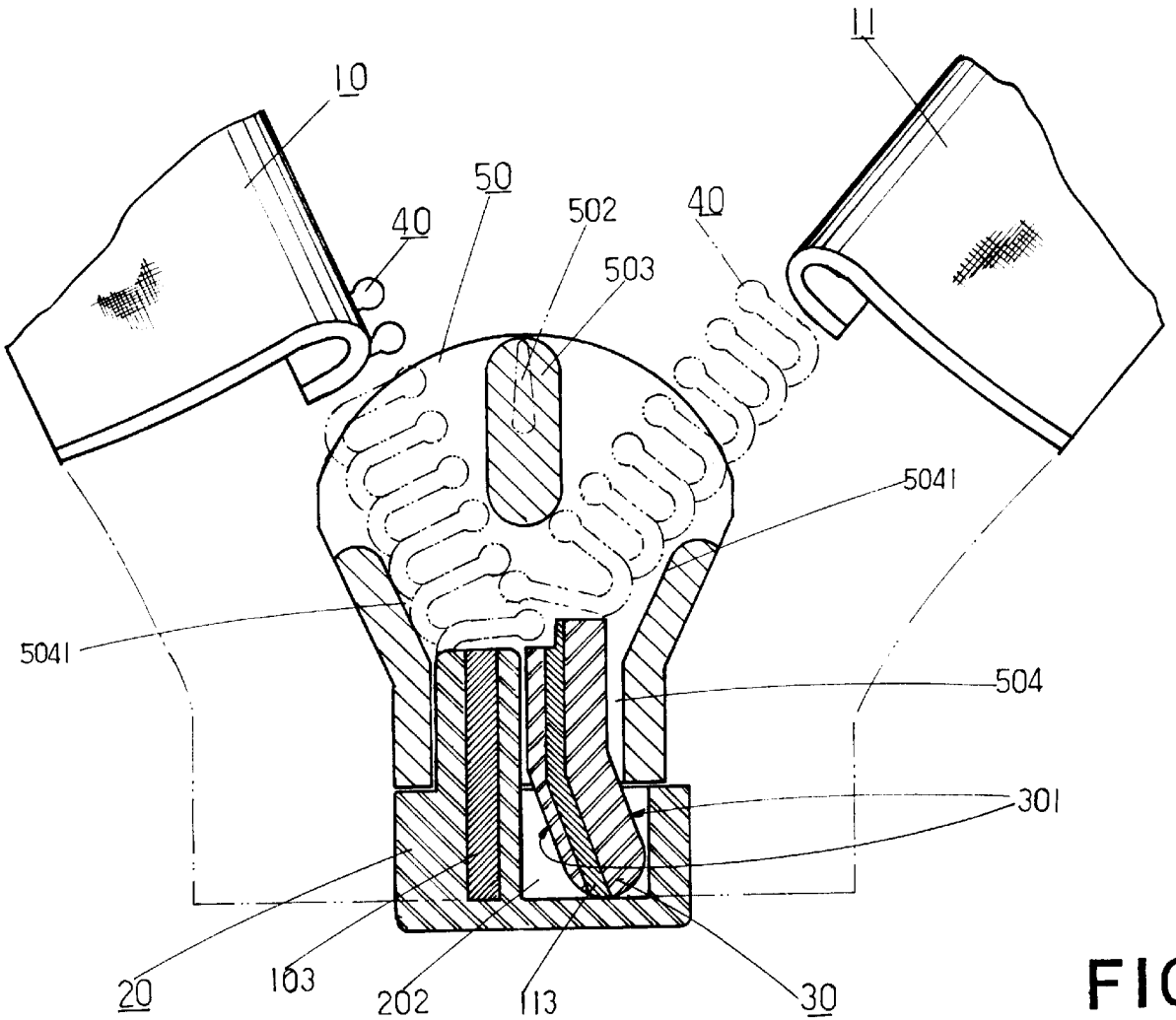
FIG. 5 is an orthographic drawing of the invention herein when drawn together with the zipper slider.
Figure 6:
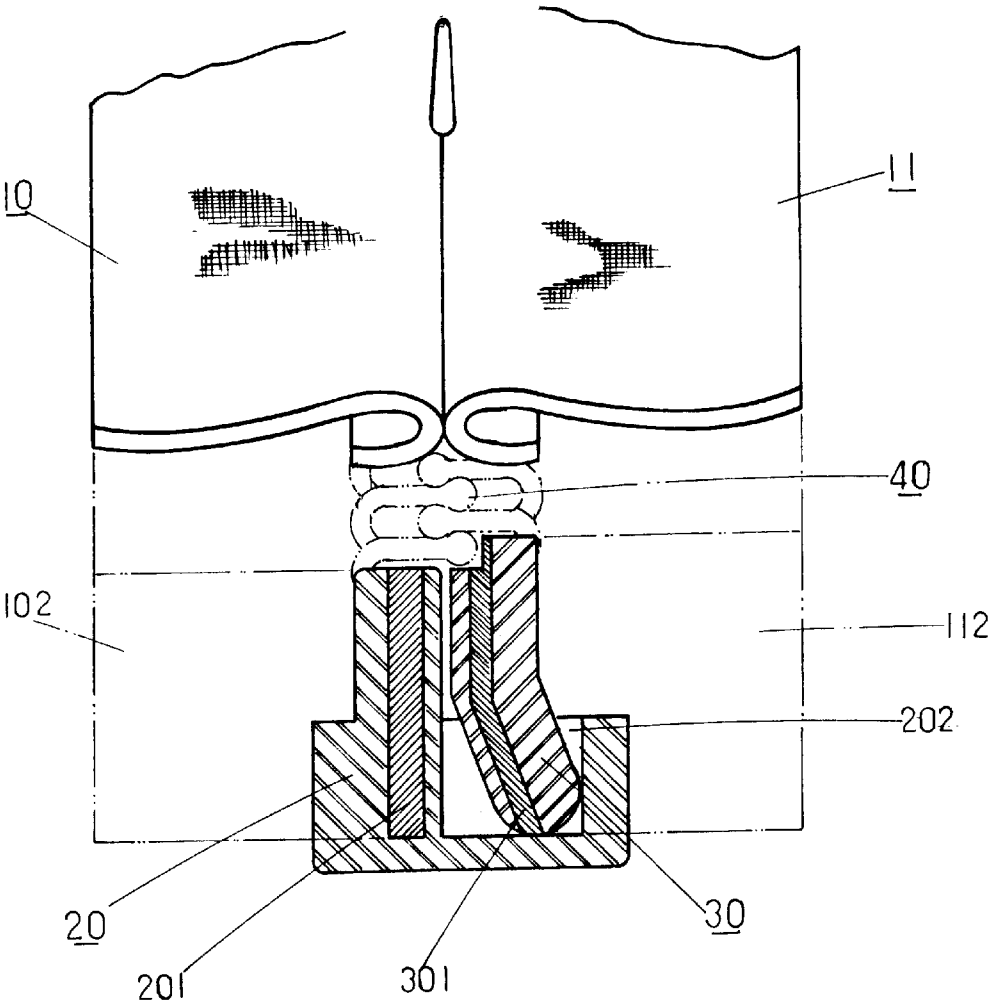
FIG. 6 is an orthographic drawing of the invention herein after the zipper slider is pulled up.

Regarding the utilization of the aforementioned structure of the invention herein, as indicated in FIG. 4, FIG. 5, and FIG. 6, since the front ends of the zipper teeth strips (10) and (11) that are pressure folded to the back surface of the attachment borders (103) and (113), respectively, are inserted into the attachment slots (201) and (303) at the front surfaces of the closure block (20) and the catch pin (30), after the zipper teeth strips (10) and (11) are fixed to the apparel, the aforesaid closure block (20) and catch pin (30) are positioned at the back surface of the zipper teeth strips (10) and (11), respectively.

Furthermore, after the zipper slider (50) is drawn onto the zipper teeth strip (10) (the placement of the aforesaid zipper slider (50) is identical to that of a conventional non-split type invisible zipper and positioned on the back surface of the zipper teeth strip (10), but the chain (503) is exposed on the front surface of the zipper teeth strip), since the attachment edge (113) of the other zipper teeth strip (11) is inserted and secured into the attachment slot (30) of the catch pin (30), and there is an excess section (c) that remains exposed and uninserted that allows the front edge (501) of the zipper slider (50) to pass through.(see FIG. 3), the aforesaid catch pin (30) can be inserted into the guide slot (504) of the zipper slider (50) and, furthermore, secured inside the insertion hole (202) of the closure block (20). Since there is a guide opening (2022) (see FIG. 3) in the front surface of the closure block (20) that allows the excess section (c) at the upper end of the attachment border (113) of the zipper teeth strip (11) to pass through, after the aforesaid catch pin (30) passes through the guide slot (504) of the zipper slider (50), the catch pin (30) enters and is secured in the insertion hole (202) of the closure block (20) without obstruction similar to the operation of a conventional zipper (a non-invisible type conventional zipper).

Furthermore, the teeth (40) of the two zipper teeth strips (10) and (11) can be drawn together or separated, and there are guide surfaces (5041) at the upper ends of the two guide slots (504) of the zipper slider (50); and since the attachment border (113) of the zipper teeth strip (11) of the invention herein passes through the guide opening (5031) and the guide opening (2022) at the front surface of the closure block (20) such that the catch pin (30) can be inserted and secured inside the insertion hole (202) of the closure block (20), unlike a conventional zipper in which the catch pin is inserted into the side of the closure block from the zipper slider, the angled guide edge (301) of the aforesaid catch pin (30) matches the guide surface of the zipper slider (50), the catch pin (30) enables the zipper slider (50) to enter and be withdrawn from the closure block (20), thereby enabling smooth and convenient operation without any operating hindrance, constituting split-type closure that can be effectively and, furthermore, conveniently utilized with an invisible zipper.

In to the foregoing section, since the two zipper teeth strips (10) and (11) have the pressure folded attachment borders (103) and (113) at the back surface that can be inserted into the attachment slots (201) and (301), respectively, at the front surface of the closure block (20) and the catch pin (30), and the closure block (20) and the catch pin (30) each have the adhesive sections (102) and 112) at the back surface of the two zipper teeth strips (10) and (11), respectively, when the zipper slider (50) is pulled to draw the two zipper teeth strips (10) and (11) together (see FIG. 6), the aforesaid closure block (20) and catch pin (30) are directly covered, as is characteristic of an invisible zipper.

What is claimed is:

1. A concealed zipper structure, comprising:

a closure block having an attachment slot and an insertion hole formed therein, said attachment slot having an L-shaped cross-section and a first plurality of locking recesses formed therein;

a first tooth strip having a J-shaped cross-section and having a first plurality of zipper teeth affixed thereto, said first tooth strip further having a first attachment border fixedly secured to a first lower end thereof, said first attachment border being received within said attachment slot and fixedly secured in locking engagement thereto by said first plurality of locking recesses;

a second tooth strip having a J-shaped cross-section and having a second plurality of zipper teeth affixed thereto, said second tooth strip further having a second attachment border fixedly secured to a second lower end thereof;

a catch pin having an attachment slot formed therethrough, said attachment slot having a second plurality of locking recesses formed therein, said second attachment border being fixedly secured in locking engagement within said attachment slot by said second plurality of locking recesses, said catch pin further having an upper portion and a lower portion, said lower portion projecting at an angle from said upper portion; and, a zipper slider having first and second guide surfaces and having a guide slot formed therethrough such that when said zipper slider is in contact with said closure block and said catch pin is received within said insertion hole, said second guide surface contacts said lower portion of said catch pin for retaining said catch pin in a fixed position within said insertion hole.

2. The lower catch for invisible zippers as recited in claim 1 wherein said second attachment border has a lower region and an upper region, said lower region being fixedly secured within said attachment slot and said upper region remaining uninserted within said catch pin.

* * * * *